US006361433B1

(12) United States Patent
Gray

(10) Patent No.: US 6,361,433 B1
(45) Date of Patent: Mar. 26, 2002

(54) VENT SCREEN AND HOOD ASSEMBLY

(76) Inventor: William R. Gray, 5321 Bule Sage Dr., Raleigh, NC (US) 27606

( * ) Notice: Subject to any disclaimer, the term of this patent is extended or adjusted under 35 U.S.C. 154(b) by 0 days.

(21) Appl. No.: 09/037,234

(22) Filed: Mar. 10, 1998

Related U.S. Application Data

(60) Provisional application No. 60/041,373, filed on Mar. 26, 1997.

(51) Int. Cl.[7] ..... F24F 7/00
(52) U.S. Cl. ..... 454/358; 454/359
(58) Field of Search ..... 454/359, 367, 454/358, 339

(56) References Cited

U.S. PATENT DOCUMENTS

| | | | | |
|---|---|---|---|---|
| 3,350,819 A | * | 11/1967 | Polidoro et al. | 454/366 |
| 3,842,722 A | | 10/1974 | Miller | |
| 4,022,117 A | * | 5/1977 | Mallian | 454/359 |
| 4,214,380 A | | 7/1980 | Meyer | |
| 4,567,816 A | * | 2/1986 | Kolt | 454/366 |
| 4,785,596 A | | 11/1988 | Wiley et al. | |
| 5,046,408 A | | 9/1991 | Eugenio | |
| 5,199,190 A | | 4/1993 | Mayer et al. | |
| 5,482,507 A | | 1/1996 | Priest | |
| 5,547,422 A | | 8/1996 | Seboldt | |
| 5,568,947 A | | 10/1996 | Paquette | |
| 5,616,076 A | | 4/1997 | Higgins | |
| 5,632,678 A | * | 5/1997 | Doelfel | 454/366 |

* cited by examiner

*Primary Examiner*—Harold Joyce
*Assistant Examiner*—Derek S. Boles
(74) *Attorney, Agent, or Firm*—Brian B. Shaw, Esq.; Stephen B. Salai, Esq.; Harter, Secrest & Emery LLP

(57) ABSTRACT

An air permeable grate or screen for selectively precluding passage of items, such as birds and rodents, through a duct is disclosed. The screen has a pivot mount on one end for pivotally mounting the screen to the exit of a hood opening to allow easy access into the hood for cleaning the hood and screen as desired. A retaining device for retaining the screen in a closed position is provided on the hood. The screen may be provided with aerodynamically designed bars for preventing lint build up. The invention further includes a method for using the vent screen within the hood.

9 Claims, 6 Drawing Sheets

VENT SCREEN AND HOOD ASSEMBLY

This application claims the benefit of Provisional Application 60/041,373 filed Mar. 26, 1997.

FIELD OF THE INVENTION

The present invention relates to an air permeable grate or screen for selectively precluding passage of items, such as birds and rodents through a duct, and more particularly to a vent hood assembly having a pivotally mounted vent screen.

BACKGROUND OF THE INVENTION

Ductwork from clothes dryers, bathroom exhaust ductwork, and the like which vent to an outdoor environment are typically provided with hooded vents that have some type of flap, which opens under air pressure from exhaust fans. Unfortunately, these flaps are often lifted open by birds and other small animals looking for nesting areas. Nesting materials can clog the vent hood causing disfunction, and, in an extreme case, lint buildup which can create a fire hazard to a dryer's heating element. In addition, animal droppings can soil the hood interior leading to unwanted odors which can be difficult to trace. Furthermore, once an animal is inside exhaust ductwork, the animal may peck or bite holes in the ductwork which can lead to further disfunction. Holes which became large enough for the animal to squeeze through provide entrances for the animal into the buildings walls or interior spaces.

The prior art has shown some attempts at solving the above-described problems. U.S. Pat. No. 5,616,076 to Higgins discloses a guard with vent bars for attachment to the mouth of a vent hood. Higgins discloses either completely attaching the guard to the mouth of the vent and selling the hood as a solid unit or attaching the guard by using a mounting strap and hinged base which are attached somehow to the hood using 3.18 mm holes provided in the base and strap. While this guard may be effective at preventing animal entry, it is either impossible or inconvenient to remove the guard for cleaning purposes. U.S. Pat. No. 5,547,422 to Seboldt discloses a protector having a cage-like body member connectable to a wall surrounding a duct outlet. The body member has a bottom panel which is provided with hinge means to permit the panel to be movable to an open condition. Again, while the protector may effectively prevent animal entry, one would not be encouraged to clean the device frequently as it would require awkward arm maneuvers to reach between the building wall and pivoted panel. Repeated opening and closing of the bendable metal cloth of the cage-like member will eventually irreparably distort the device. In addition, one may not even want to install such a protector as it would require placing additional holes in the building exterior. Furthermore, many building owners would find such a cage-like member an unnattractive addition to the building. U.S. Pat. No. 5,046,408 to Eugenio discloses a screen placed onto the opening of a hood which is fastened by "unique clips." Again, entry into the hood is either impossible or inconvenient.

Thus, there is a need for a vent screen which can prevent animals from entering into a hood assembly and creating havoc in the duct work. There is further a need for such a vent screen which can be easily assembled onto a hood without the need of screws. There is further a need for a vent screen which is sturdy enough to withstand repetitive opening and closing operations. There is further a need for a vent screen which can be easily removed for cleaning and which, when in an open position, does not get in the way of the cleaning process. There is further a need for a vent screen having bars that limit the amount of cleaning necessary.

SUMMARY OF THE INVENTION

Thus, it is an object of the present invention to provide a vent screen which will protect the interior of hoods and duct work from birds and other animals.

It is another object of the present invention to provide a vent screen which can be attached to a hood assembly using a snap-fit connection.

It is another object of the present invention to provide a vent screen which is pivotal with respect to the hood assembly and which pivots in a direction to move the area of the screen requiring cleaning in a direction facing the user and in a direction which does not hinder entry into the hood assembly for cleaning.

It is a further object of the present invention to provide a vent screen which can be snapped closed from its pivoted open position.

It is a further object of the present invention to provide a vent screen having vent bars with a tapered leading edge for ease in cleaning.

It is yet another object of the present invention to provide a vent screen which is molded to provide the pivot bars and for molding an aerodynamic shape in the vent bars.

It is a further object of the present invention to provide a hood assembly with retention tabs for retaining the vent screen in a closed position and pivot recesses for allowing the vent screen to pivot to an open position.

Other objects will in part be obvious and in part appear hereinafter.

In a preferred embodiment of the present invention, the hood assembly for exterior ducts comprises a hood for connecting to a terminal end of a duct for directing air flow from along an axis of the duct to an off-axis direction, preferably substantially perpendicularly, the hood defining an opening for permitting fluid flow in the off-axis direction, and a screen releasably connected to the hood to substantially occupy the entire opening, the screen having a plurality of vent bars extending across the hood opening, the vent bars including a leading edge with respect to air flow passing through the opening, wherein the screen is pivotally mounted to the hood.

The hood may comprise a mounting panel for surrounding the terminal end of a duct such that the screen is pivotally mounted to the hood adjacent the mounting panel. This assists the user in cleaning the hood and screen by allowing the screen to be pivoted towards a building wall in an out of the way position. The pivotal nature of the screen with respect to the hood may be accomplished by pivot bars extending from a pivoting end of the screen received within recesses in the hood.

Preferably, a cross-section of the leading edge of the vent bars is tapered to a point. The cross-section may be triangular, or may be defined by the intersection of two circles. The tapered leading edge reduces the stagnation points of air flow past the vent screen, thus reducing the debris that is collected on the leading surface. The hood and screen are preferably both molded in plastic.

The hood assembly further may comprise cooperating friction fit mechanisms on the hood and screen or tabs on the hood for releasably engaging the screen to the hood to preclude rotation. Stopping blocks within the hood prevent over-rotation of the screen into the hood.

Thus, a preferred embodiment of the present invention embraces a method for protecting an opening of a duct hood, the duct hood having a mounting panel accessible to a vent duct, the method comprising the steps of providing the duct hood with a pair of recesses on an inner side of the hood adjacent the mounting panel, providing the duct hood with tabs on an outer side of the hood, opposite the recesses, attaching the mounting panel to a building wall over a vent duct, providing a vent screen with crossing vent bars creating apertures sized to prevent the ingress of small animals, providing the vent screen with pivot bars on opposite sides of a pivoting end of the vent screen, the pivot bars substantially sharing a plane with the vent screen, inserting the pivot bars into the recesses of the duct hood, pivoting the vent screen to cover the opening, and pushing the vent screen past the tabs of the duct hood to frictionally retain the vent screen in a closed position substantially flush with the opening of the duct hood.

The cleaning of the duct hood and the inner surface of the vent screen may be accomplished by pulling the closing end of the vent screen away from the opening to pull the screen past the tabs of the duct hood, pivoting the vent screen about the recesses in the duct hood and towards the building wall to place the vent screen in an open position, removing lint and debris from the duct hood and cleaning an inner surface of the vent screen, pivoting the vent screen back to the closed position, and pushing the screen past the tabs of the duct hood.

The foregoing and other features and advantages of the invention will be more readily understood and fully appreciated from the following detailed description, taken in conjunction with the accompanying drawings.

DETAILED DESCRIPTION OF THE PREFERRED EMBODIMENTS

Figure 1A:
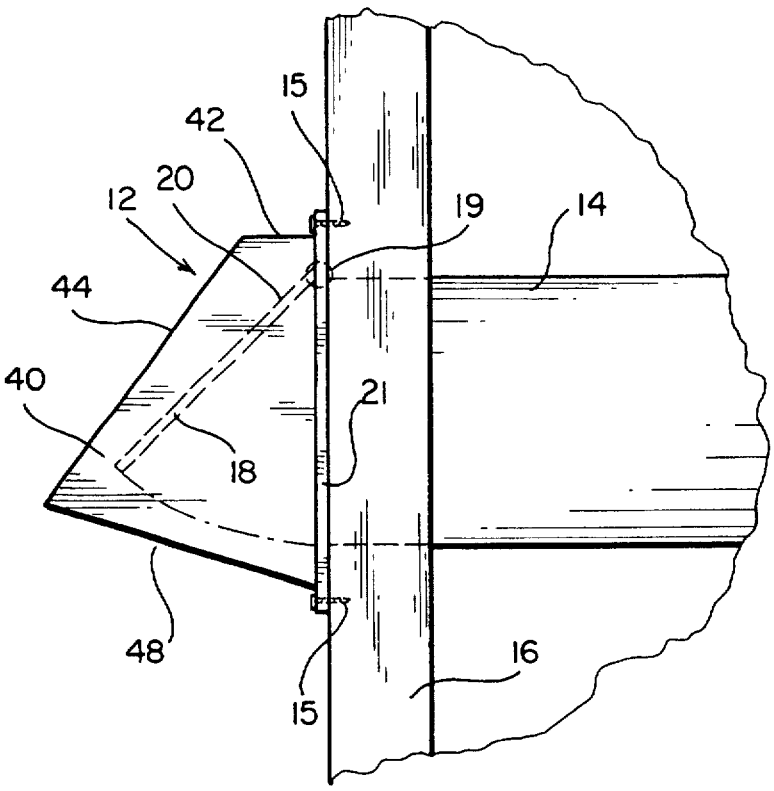
FIG. 1A shows a side view of the hood assembly of the present invention and FIG. 1B shows a side perspective view of the hood assembly of the present invention.
Figure 1B:
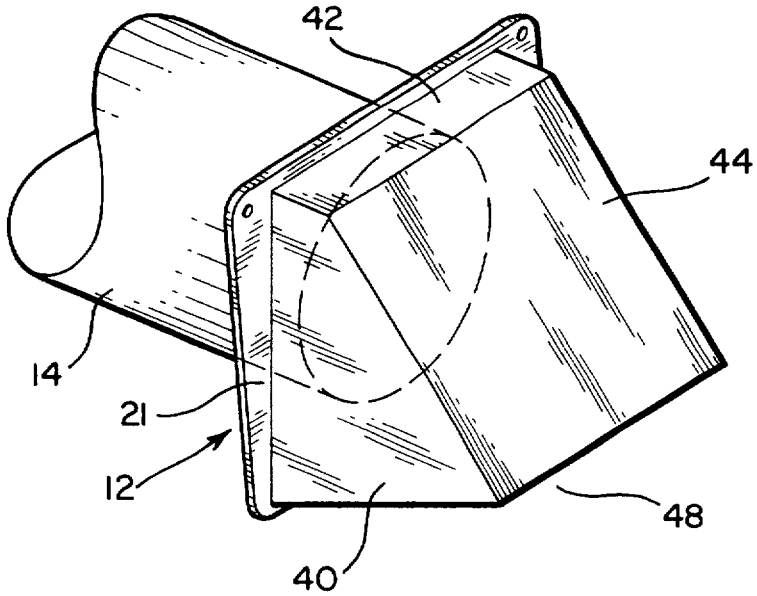

A side view and a perspective view of a duct and duct housing or hood are shown in FIGS. 1A and 1B with the vent screen of the present invention removed. A vent duct 14 leads exhaust substance from associated equipment such as a clothes dryer interiorly of a building wall 16 to vent discharge exteriorly of the wall 16. The vent duct outlet or hood assembly 12 is connected to the wall 16, such as by nailing or screwing with retainment elements 15, and extends outwardly of the wall 16. The hood assembly 12 may have a movable closure flap 18 hingedly connected at 19. The flap 18, if used, moves between a substance-discharge position 20, which permits the exhaust substance to be discharged through the hood assembly 12, and a gravity-biased closed (vertical) position against the mounting panel 21 of the hood assembly 12, providing a loosely held closure of the hood assembly 12. The hood assembly 12 is provided with side panels 40, top panel 42, and an exterior facing slanted panel 44. The panel 44 of hood assembly 12 is slanted so as to baffle or direct lint particles downwardly rather than straight ahead into the surrounding yard. A duct 14 with a 4 inch diameter, for example, may have a hood assembly 12 with an approximately 4 inch×4 inch opening 48. Of course, the size of the hood assembly could be modified for varying outputs and could be made larger or smaller depending on the duct size. In addition, the opening 48 need not be square and therefore the sides could be made slightly larger or smaller to accommodate design requirements.

Figure 2:
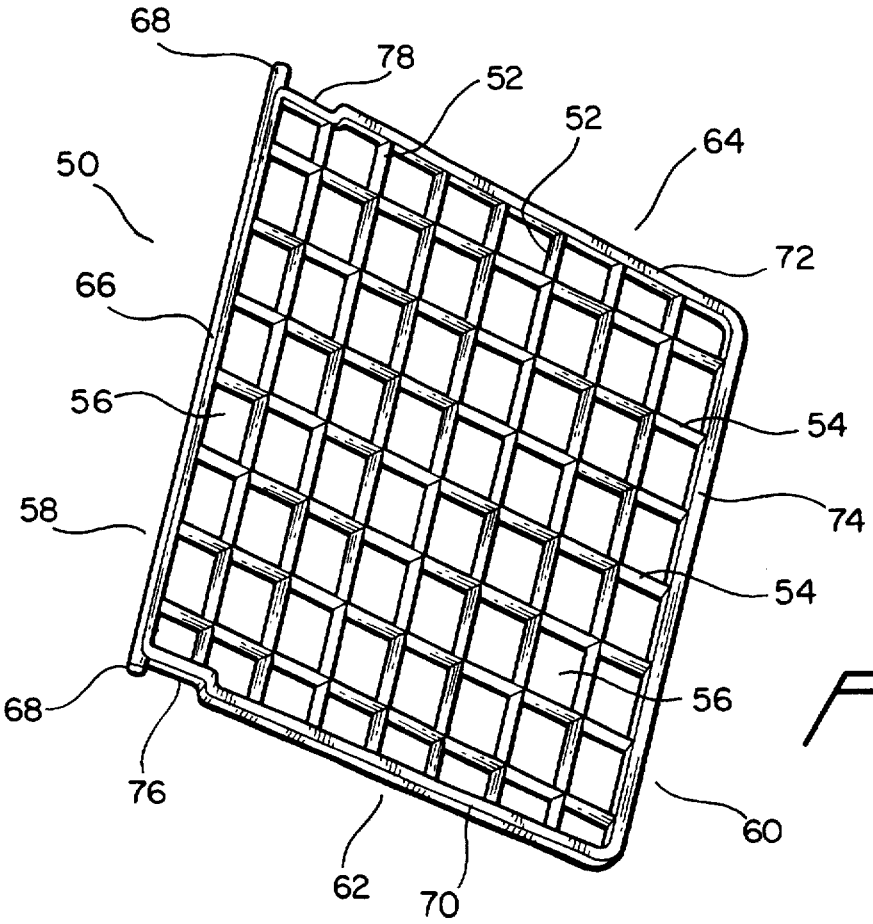
FIG. 2 shows a top perspective view of a vent screen in a preferred embodiment of the present invention.
Figure 3:
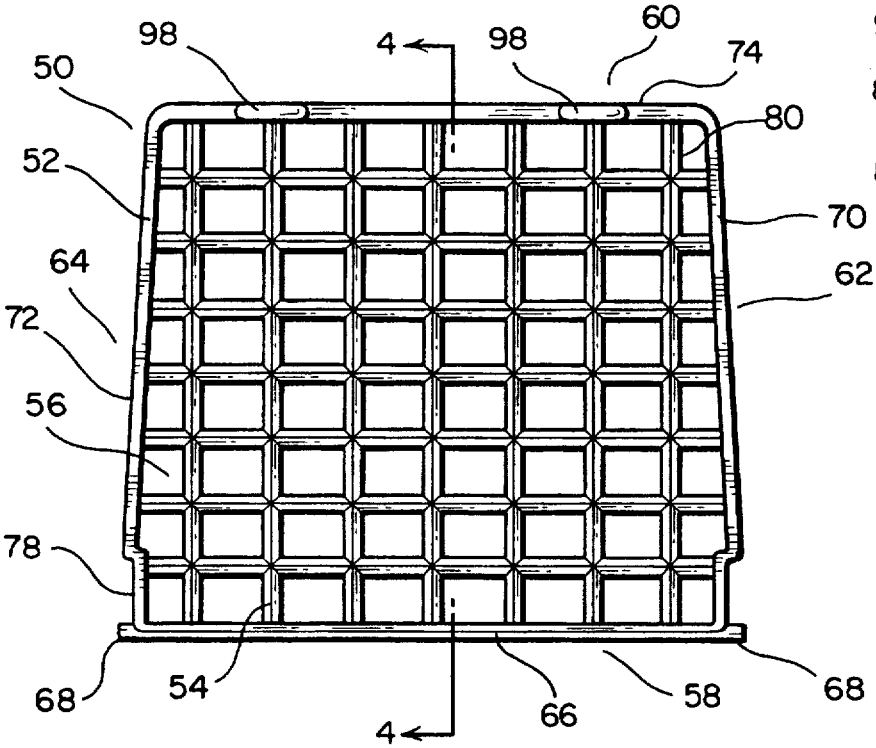
FIG. 3 shows a top plan view of a vent screen in a preferred embodiment of the present invention.

As shown in FIGS. 2 and 3, a preferred embodiment of the present invention comprises a vent screen 50 for covering the opening 48 of the hood assembly 12. The vent screen 50 is preferably made from injection molded plastic, but may be made from metal or other durable material which has memory to retain the original shape shown and described. The vent screen 50 preferably comprises a first set of vent bars 52 and a second set of vent bars 54 that run substantially perpendicularly to the first set of vent bars 52. Although shown and described as substantially perpendicular, it should be understood that the bars 52 and 54 may be at any angles relative to one another so long as the plurality of openings 56 created by the intersecting bars are small enough to block entry of small animals into the hood assembly 12, but large enough to allow the flow of exhaust. Suitable sizes for the openings 56 may be in the range of approximately 1/16 inch×1/16 inch to approximately 1 inch×1 inch. The openings 56 need not be square, and, in a preferred emodiment, the openings are approximately ½ inch×⅜ inch. Of course, larger or smaller openings to suit the needs of various geographical areas or applications would be within the scope of this invention.

The vent screen 50 further comprises a pivoting end 58, an opening end 60, a first side 62 and a second side 64. The pivoting end 58 preferably has a bar 66 with two pivot bars 68 on either end. The pivot bars 68 thus lie substantially within the same plane as the vent screen 50. The pivot bars 68 may engage with recesses in the hood assembly as will be described for allowing the vent screen 50 to pivot with respect to the opening 48. Each side 62 and 64 comprises a side bar 70 and 72, respectively, which connect to the bar 66. The opening end 60 has a bar 74 which connects the side bars 70 and 72 and is preferably substantially parallel to the bar 66. Although a specific orientation of bars is described and shown, it should be understood that the vent screen 50 could be dimensioned to fit inside the opening 48 of any hood assembly 12. For example, indents 76 and 78 may be provided on side bars 70 and 72, respectively, so that the vent screen 50 may fit inside a correspondingly shaped hood assembly 12.

Figure 4:
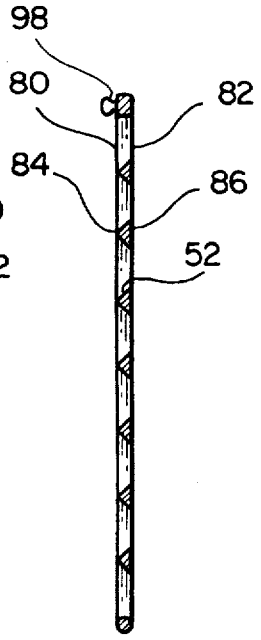
FIG. 4 shows a side cross-sectional view of the vent screen of FIG. 3 taken along line 4—4 in FIG. 3.

FIG. 4 shows a side cross-sectional view taken along line 4—4 in FIG. 3. As shown in FIG. 4, each vent bar 52 may be provided with a triangular cross-section where a point of the triangular cross-section lies within the plane of the leading surface 80 of the vent screen 50. That is, the upper side of the vent screen 50 which faces the opening 48 of the hood assembly 12 is defined as the leading surface area 80 and the lower side of the vent screen 50 which is parallel to and furthest away from the leading surface area 80 is defined as the trailing surface area 82. Thus, the leading edge 84 of a vent bar 52 is an edge of a triangular wedge while the trailing edge 86 of a vent bar 52 is a plane of a triangular wedge. Because standard wires and bars are only provided in circular and sometimes square cross-sections, the vent screen 50 of the present invention is preferably injection molded in plastic to achieve the vent bar cross-section with aerodynamic leading edges 84. The pointed cross-section of the vent bars limits the area for stagnation points encountered by fluid flow through the hood assembly 12, thus decreasing the chance for debris to remain attached to the leading surface area 80 of the vent screen 50. The leading surfaces of each vent bar taper towards the leading edge for creating the aerodynmic effect.

Figure 5:
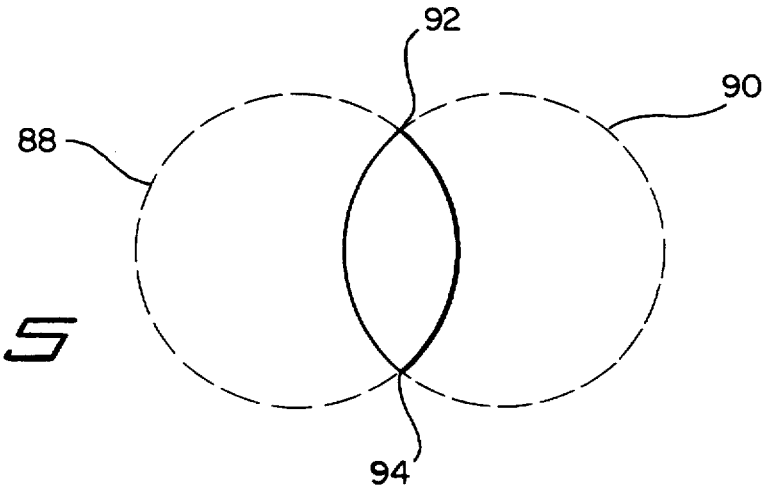
FIG. 5 shows a side cross-sectional view of a vent bar in an alternate embodiment of a vent screen of the present invention.

An alternative cross-section of a vent bar 52 or 54 is shown in FIG. 5. The cross-section is substantially defined by the intersection of two circles 88 and 90, shown in phantom. The leading edge 92 is again a line in the leading surface area 80 of the vent screen 50. Thus, the area for stagnation points is reduced, substantially decreasing the likelihood of debris residing on the leading surface area 80 of the vent screen 50. In this embodiment, however, the trailing edge 94 is also a line, as opposed to a plane, in the trailing surface area 82. This assists fluid flow through the vent screen by streamlining the vent bars to reduce the wake at the trailing surface. The wake is reduced because the onset of separation of the boundary layer from the object is delayed. Despite these advantages, the embodiment disclosed in FIG. 4 may sometimes be preferred due to manufacturing considerations.

Figure 6A:
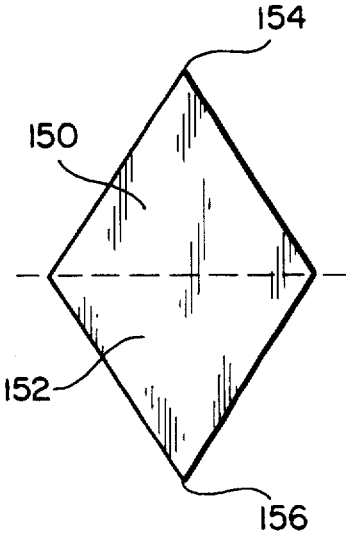
FIGS. 6A and 6B show side cross-sectional views of vent bars in a preferred embodiment of a vent screen of the present invention.
Figure 6B:
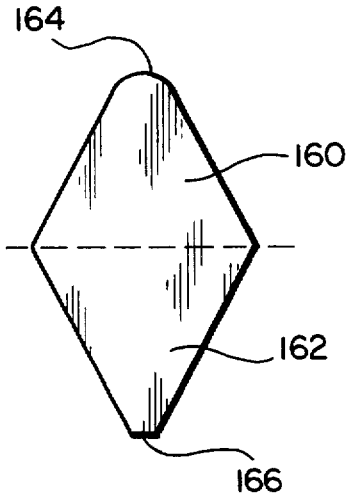

In yet another embodiment shown in FIGS. 6A and 6B, the vent bar may have a triangular shaped cross-section on both sides of the bar. As shown in FIG. 6A, a first triangular cross-section 150 including a leading edge 154 abuts a second triangular cross-section 152 that includes a trailing edge 156. Similarly as shown in FIG. 6B, a first substantially triangularly shaped cross-section 160 including a leading edge 164 abuts a second substantially triangularly shaped cross-section 162 that includes a trailing edge 166. While the vent bar of FIG. 6A has a pointed crosssection, the vent bar of FIG. 6B may have a slightly rounded or truncated cross-section at the points lying along the leading and trailing edges 164, 166 for ease in manufacturing when injection molding plastic. Nonetheless, each embodiment utilizes vent bars which have leading surfaces tapering towards the leading edge to create the aerodynamic effect. Any combination of the above-described cross-sections are within the scope of this invention so long as the leading edge is aerodynamically designed and preferably reduces stagnation points.

Figure 9:
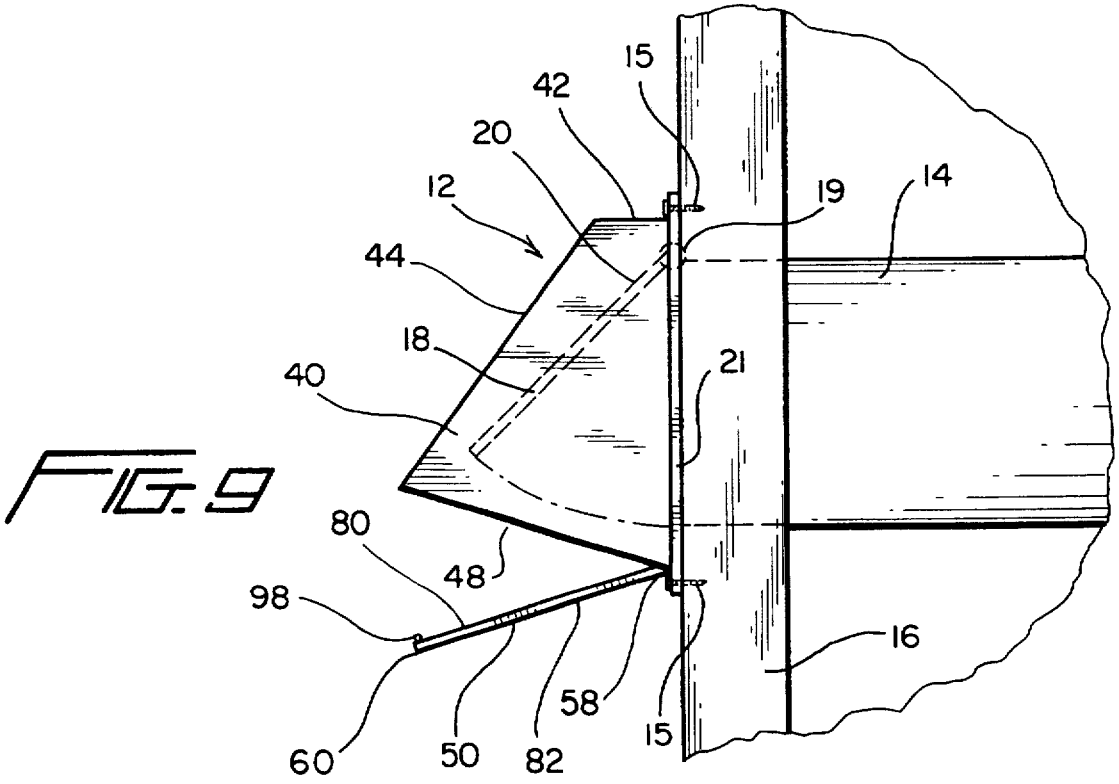
FIG. 9 shows a side view of the hood assembly with a vent screen pivoted to a partially open position.
Figure 7:
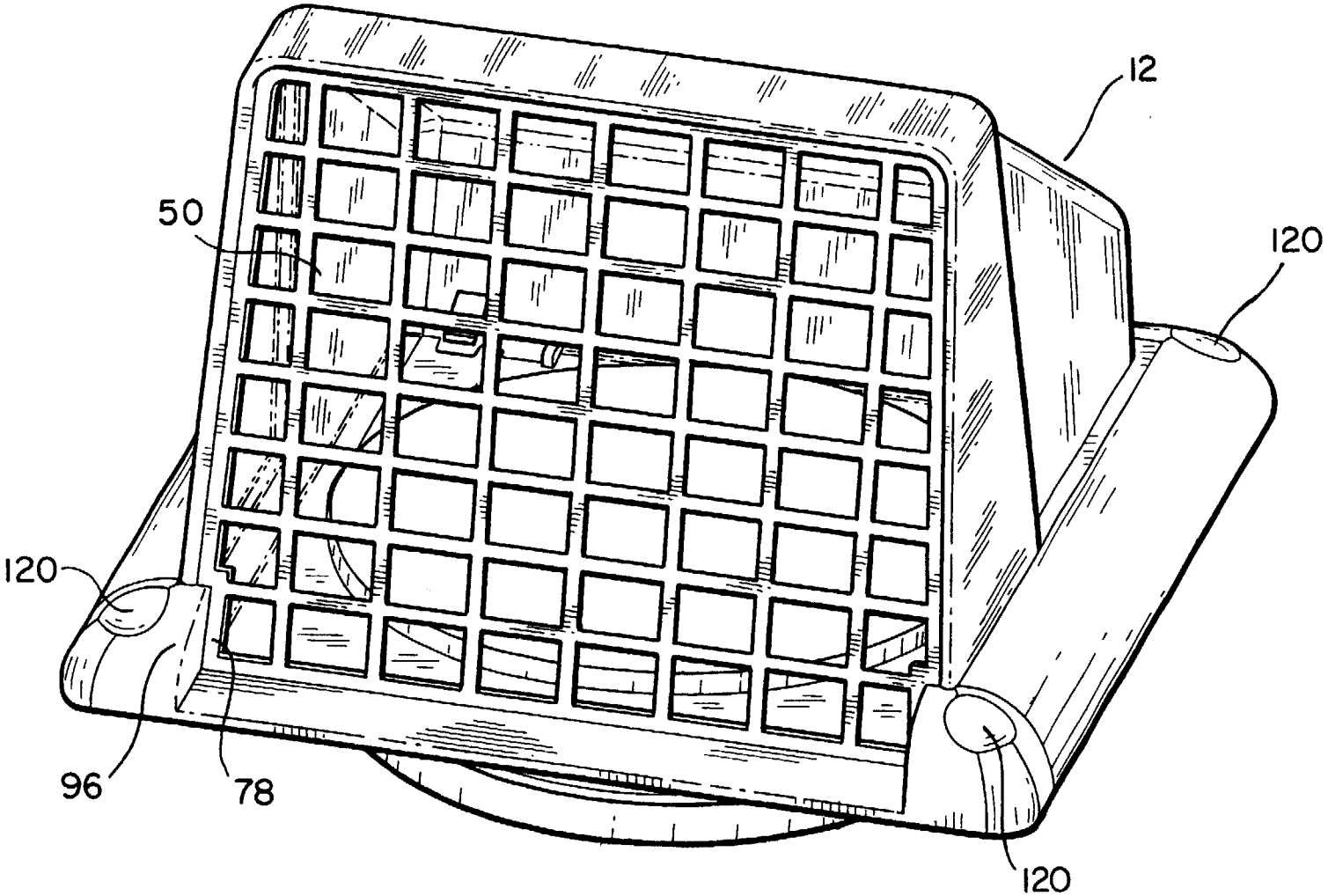
FIG. 7 shows a perspective view of a vent screen and hood assembly in a preferred embodiment of the present invention.

FIG. 7 shows a vent screen 50 of the present invention in place over an opening 48 of a hood assembly 12. The pivot bars 68, hidden from view in FIG. 7, are disposed in recesses 104 in the hood assembly 12, shown in FIG. 8. Thus, the vent screen 50 may be pivoted to a closed position as shown in FIG. 7, or may be pivoted to an open position as shown in FIG. 9. The particular hood assembly 12 shown in FIG. 7 is provided with protrusions 96 which match correspondingly shaped indents 78. In addition, the vent screen 50 lies flush with the opening 48 of the hood assembly 12 so as not to add to the disruption of the exterior surface of the building wall 16 already caused by the hood assembly 12. The hood assembly 12 is shown with screw or nail accepting apertures 120 for securing the hood assembly to a wall 16 with retainment elements 15 or the like.

As shown in FIG. 9, the trailing surface 82 of the vent screen 50 preferably pivots towards the building wall 16 rather than away from it. That is, the pivoting end 58 is closer to the building wall 16 than the opening end 60 such that the bar 66 is substantially adjacent to the mounting panel 21. This positioning of the vent screen 50 further assists the user in cleaning the vent screen 50 by facing the area of the vent screen 50 to be cleaned (i.e., the leading surface 80) directly towards the user and by allowing free access to the interior of the hood assembly 12 when the vent screen 50 is pivoted in its open position.

Figure 11:
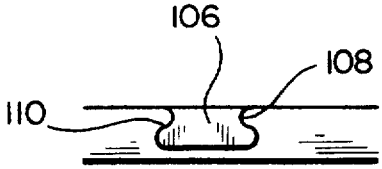
FIG. 11 shows an interior cross-sectional view, taken along line 11—11 in FIG. 8, of an indent in the hood assembly in one embodiment of the present invention.
Figure 8:
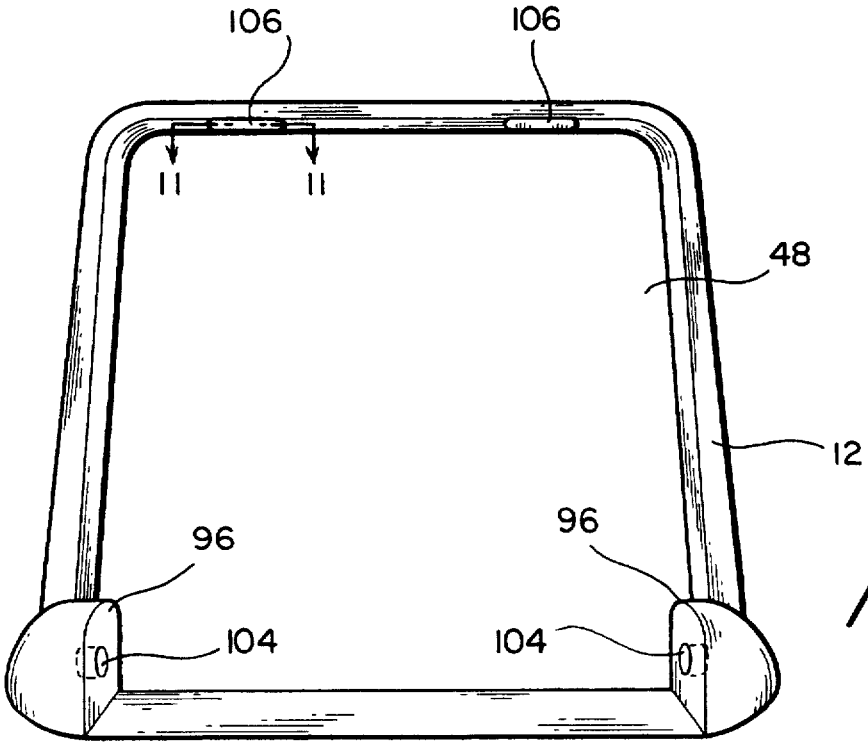
FIG. 8 shows a plan view of an opening in a hood assembly in one embodiment of the present invention.
Figure 10:
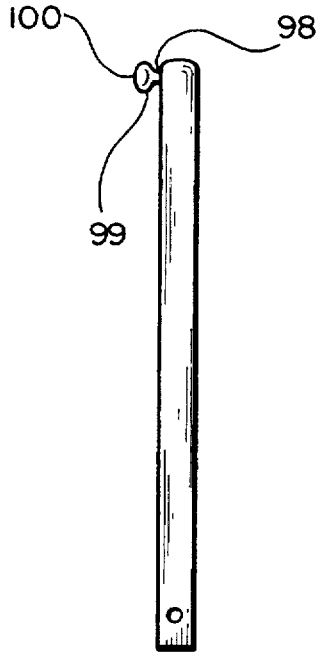
FIG. 10 shows a side view of a side bar of a vent screen in one embodiment of the present invention.

To prevent the vent screen from swinging open due to gravity, the vent screen 50 and the hood assembly 12 may be provided with a cooperating friction fit mechanisms. For example in one embodiment, as shown in FIGS. 3 and 10, the vent screen 50 may be provided with two spaced apart tabs 98 in the bar 74 of the opening end 60. The spaced apart tabs 98 may have thin necks 99 and terminal bulbous portions 100. The hood assembly 12 may be provided with correspondingly shaped and spaced apart indents 106, as shown in FIGS. 8 and 11. Although two tabs have been shown, it should be understood that it would be possible to use only one central tab, and it would also be within the scope of the invention to include more than two spaced apart tabs. When the vent screen 50 is pushed towards its closed and flush position shown in FIG. 7, the tabs 98 encounter resistance to entrance within the indents 106 due to the terminal bulbous portions 100 being somewhat wider than entrance necks 108. With slight force, the tabs 98 may be pushed within the indents 106 and remain in there despite the pull of gravity due to the bulbous portions 100 resting on ledges 110 of indents 106. To reopen the vent screen 50, the user need only grab the vent screen 50 through the openings 56 and apply a small pulling force to release the portions 100 from the indents 106.

Figure 12:
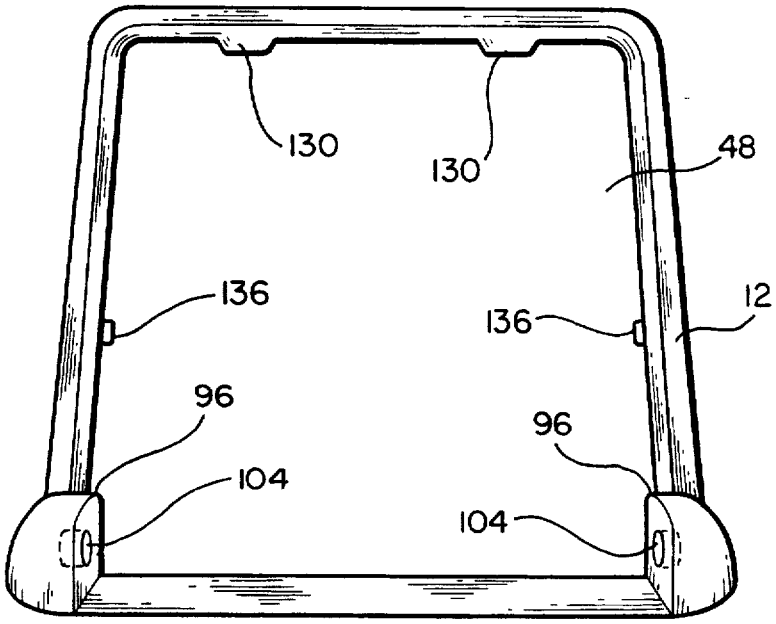
FIG. 12 shows a plan view of a hood opening in a hood assembly in a preferred embodiment of the present invention.
Figure 13:
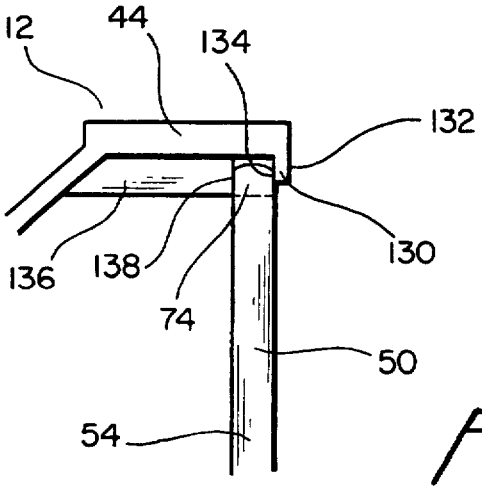
FIG. 13 shows a cross-sectional view of the screen within the hood in the preferred embodiment of the present invention.

Turning now to FIGS. 12 and 13, in a preferred embodiment for retaining the vent screen 50 in a closed position within the opening 48 of the housing 12, tabs 130 depend from exterior facing panel 44 and may extend into the area of the opening 48. The vent screen 50 need not be provided with any corresponding groove or tab. Instead, when the vent screen 50 is pivoted toward the opening 48, the vent screen 50 requires only a small pushing force to push the vent screen 50 against an exterior side 132 of the tabs 130 and then past the tabs 130. Due to gravity, the bar 74 of the opening end 60 will rest against an interior side 134 of the tabs 130, but the force of gravity is not enough to push the bar 74 past the tabs 130. Instead, a small pulling force can release the vent screen 50 from the opening 48 by pulling the bar 74 past the tabs 130. As shown in FIG. 13, a stopping block 136 may be provided behind a tab 130. The stopping block 136 is provided with a stopping edge 138, spaced a distance slightly greater than the width of bar 74 behind a tab 130. When the bar 74 is pushed past the tab 130, it abuts the stopping edge 138 and the vent screen 50 is thus prevented from making further movements into the housing 12 which could cause damage to either the housing 12 or the vent screen 50. Additional stopping blocks 136 could be provided along the side panels 40 of the housing 12.

Thus, it is apparent that there has been provided, in accordance with the invention, a vent screen and hood assembly that fully satisfies the objects and advantages set forth above. The vent screen prevents the ingress of birds and small animals, pivots open in an unobstrusive position for cleaning, may be provided with vent bars to limit the time needed to be spent cleaning, and is sturdy enough to withstand repeated opening and closing operations. While the invention has been described in conjunction with specific embodiments thereof, it is evident that many alternatives, modifications, and variations will be apparent to those skilled in the art in light of the foregoing description. For example, the vent screen could be molded with circular openings as opposed to the polygonal openings shown and described. In addition, the vent screen could be provided with recesses within the bar 66 and indents within the bar 74 for receiving correspondingly shaped pivot bars and tabs jutting out from the opening of the hood assembly. Accordingly, the present invention is intended to embrace all such alternatives, modifications, and variations as fall within the spirit and broad scope of the appended claims.

What is claimed is:

1. A hood assembly for exterior ducts comprising:

a) a hood for connecting to a terminal end of a duct for directing air flow from along an axis of the duct, the hood defining an opening for restricting fluid flow to an off-axis direction relative to the axis of the duct; and b) a screen releasably connected to the hood to substantially span the entire opening, the screen having a plurality of vent bars extending across the hood opening, the vent bars including a leading edge with respect to air flow passing through the opening, wherein the screen is mounted to the hood to assume either a closed position wherein the screen covers the hood opening or an open position allowing access into the hood and a cross-section of the vent bars is non-circular and includes two leading surfaces which taper towards the leading edge.

2. The hood assembly of claim 1 wherein the hood comprises a mounting panel for surrounding the terminal end of a duct, the screen being pivotally mounted to the hood adjacent the mounting panel.

3. The hood assembly of claim 2 wherein pivot bars extend from opposite sides of the screen and are received by recesses in the hood.

4. The hood assembly of claim 1 wherein the hood comprises a mounting panel for surrounding the terminal end of a duct and tabs for retaining the screen within the opening, the screen being pivotally mounted to the hood adjacent the mounting panel.

5. The hood assembly of claim 1 wherein the screen is made from plastic.

6. The hood assembly of claim 5 wherein the hood is made from plastic.

7. The hood assembly of claim 1 further comprising tabs on the hood extending within the opening for retaining the screen in the closed position.

8. The hood assembly of claim 7 further comprising stopping blocks within the hood behind the tabs, the stopping blocks designed to abut the screen in the closed position.

9. The hood assembly of claim 1 further comprising cooperating friction fit mechanisms on the hood and screen for releasably engaging the screen to the hood to preclude rotation.

* * * * *

UNITED STATES PATENT AND TRADEMARK OFFICE

CERTIFICATE OF CORRECTION

PATENT NO. : 6,361,433 B1
DATED : March 26, 2002
INVENTOR(S) : William R. Gray

It is certified that error appears in the above-identified patent and that said Letters Patent is hereby corrected as shown below:

Title page,
Item [76], Inventor, should read as follows: -- William R. Gray, 5321 Blue Sage Dr., Raleigh, NC (US) 27606 --

Signed and Sealed this

Twenty-third Day of September, 2003

JAMES E. ROGAN
*Director of the United States Patent and Trademark Office*